United States Patent [19]

Dahnert et al.

[11] Patent Number: 5,050,941

[45] Date of Patent: Sep. 24, 1991

[54] SWITCH ASSEMBLY AND MOBILE STORAGE UNIT USING THE ASSEMBLY

[75] Inventors: Dean L. Dahnert, Fort Atkinson; Marvin L. Runge, Edgerton, both of Wis.

[73] Assignee: Spacesaver Corporation, Fort Atkinson, Wis.

[21] Appl. No.: 476,314

[22] Filed: Feb. 7, 1990

[51] Int. Cl.[5] ..... A47B 88/00

[52] U.S. Cl. ..... 312/201; 200/343

[58] Field of Search ..... 200/343, 344, 345, 341, 200/520; 312/201

[56] References Cited

U.S. PATENT DOCUMENTS

| | | | |
|---|---|---|---|
| 3,826,882 | 7/1974 | Giolitti et al. | 200/343 X |
| 4,582,967 | 4/1986 | Brumit et al. | 200/343 X |
| 4,743,078 | 5/1988 | Dahnert | 312/201 |

*Primary Examiner*—Joseph Falk

*Attorney, Agent, or Firm*—Fuller, Ryan & Hohenfeldt

[57] ABSTRACT

The housing of a switch assembly has four plastic walls which are joined integrally during molding and encompass a nominally open area. A panel spans across the front of the opening and is molded integrally with the walls. The panel has a laterally extending slit and several slits which are perpendicular to the lateral slit and divide the panel into cantilever supported deflectable push button switch operators. At the front of the switch housing and covering part of the area of the opening is a swingable door which conceals a multiple contact connector. Several different types of key devices are adapted for plugging into the connector for modifying the ordinary functions of the switch assembly. When used on a mobile storage system unit, one key overrides the controls when a safety device is activated. Another key device can be plugged in to dominate control over the normal push buttons of the switch assembly. Another key device is adapted to supply emergency power from a battery power pack. One of the push buttons of the switch assembly is provided with light transmitting arrows and there are an array or red and green LED's mounted on a circuit board behind these oppositely pointing arrows. Both arrows my be lighted green or red or one may be green and the other red. The housing is provided with screw driver operated clamping fingers which can be turned after the housing is inserted into a hole in a wall to lock the housing in the wall.

11 Claims, 2 Drawing Sheets

SWITCH ASSEMBLY AND MOBILE STORAGE UNIT USING THE ASSEMBLY

BACKGROUND OF THE INVENTION

The invention disclosed herein relates to a multi-function switch assembly and use of the switch assembly to control mobile storage units.

Movable storage systems comprise a series of storage units which have shelves or bins, for example, and are movable on tracks to create an access aisle between two of the units and to establish the others in close side-by-side relationship to minimize the amount of floor space required for the units. Movements of the units to open and closed aisles are usually controlled by push button switches which are affiliated with variously colored light sources which indicate the operational status of the mobile storage units to the user. The push button switches are conventionally made up as individual switches and so are the light switches which were mounted to a microprocessor based logic and control module which was also set in an end wall of the storage unit behind the push button and indicator light assembly. The conventional arrangement required a considerable amount of hard wiring of the individual switches and light sources during construction of the storage units. In the conventional arrangement, when an indicator light of a particular color turned on, the user would have to remember what one or more of the energized lights was intended to indicate and would also have to relate ]t to the direction in which the storage units were moving in the process of either opening or closing an aisle between units.

SUMMARY OF THE INvENTION

An objective of the invention is to provide a multi-functional switching and indicating assembly or device which is not only useful to control movable storage units but also has many other general purpose applications where users control electrically operated apparatus.

More specifically, the invention features a switch assembly which combines multiple switches, switching circuits and informational indicating lights into an entity. The assembly comprises a molded plastic shell or body which, in a preferred embodiment, has four walls which are molded as a single piece and which define the boundaries of a space or opening A panel which is molded integrally or in one piece with the housing walls spans across the opening and covers part of the opening This panel has a slit which extends laterally across the opening and there are a plurality of slits which are transverse to the lateral slit and intersect it such that the panel is divided into a plurality of switch operator members where one portion of each switch operating member remains joined with the panel and is supported in cantilever fashion to provide for being deflected in response to application of a force on the front side of the member and for restoring automatically to undeflected condition when the force is removed. Deflection of the operating members causes switches which are mounted on support means behind them to be operated.

In a preferred embodiment, the support means for the switches comprises a circuit board on which circuitry and multiple contact connectors are mounted. Use of these connectors minimizes the amount of hard wiring necessary during installation of a storage unit system, for example.

One of the cantilever self-returning switch operating members is provided with prismatic lens elements which are comprised of elongated prisms and are triangular in shape and serve as arrows which relate to the direction in which one or all of the storage units are moving or to some condition which exists in the storage unit system. It is the apexes of the triangles which are formed with the prismatic lenses which constitute the pointers In an actual embodiment, there is a red light emitting diode and a green light emitting diode behind each of the arrows. Thus, the left pointing arrow and the right pointing arrow can be caused to illuminate either red or green or both arrows may be caused to display the same color simultaneously. The summation of the various illumination conditions of the prismatic lens and the lack of illumination, provides for indicating at least seven different conditions which are pertinent to operating electrically powered devices such as mobile storage units.

An important feature of the prismatic lens arrows is their capability of projecting light with equal intensity when viewed from above or below or in a direct line of sight. This feature is especially beneficial to and considerate of users who are obliged to operate the switch from a low level while sitting in a wheelchair, for example, in which case they must look upwardly to perceive the illumination conditions of the prismatic lens arrows which they can now do with ease and certainty.

The switch assembly also features quick locking devices which clamp the switch assembly securely to a wall which contains a hole corresponding in shape to the switch assembly housing by merely turning two screws which control clamping fingers.

The switch assembly has a front door next to the panel with which the switch operating members are created. There is a multiple contact connector behind the door. Opening the door permits plugging several different key devices into the connector for executing different control functions.

How the foregoing features and other features of the invention are accomplished will be evident in the ensuing more detailed description of a set forth in to the drawings.

DESCRIPTION OF A PREFERRED EMBODIMENT

Figure 1:
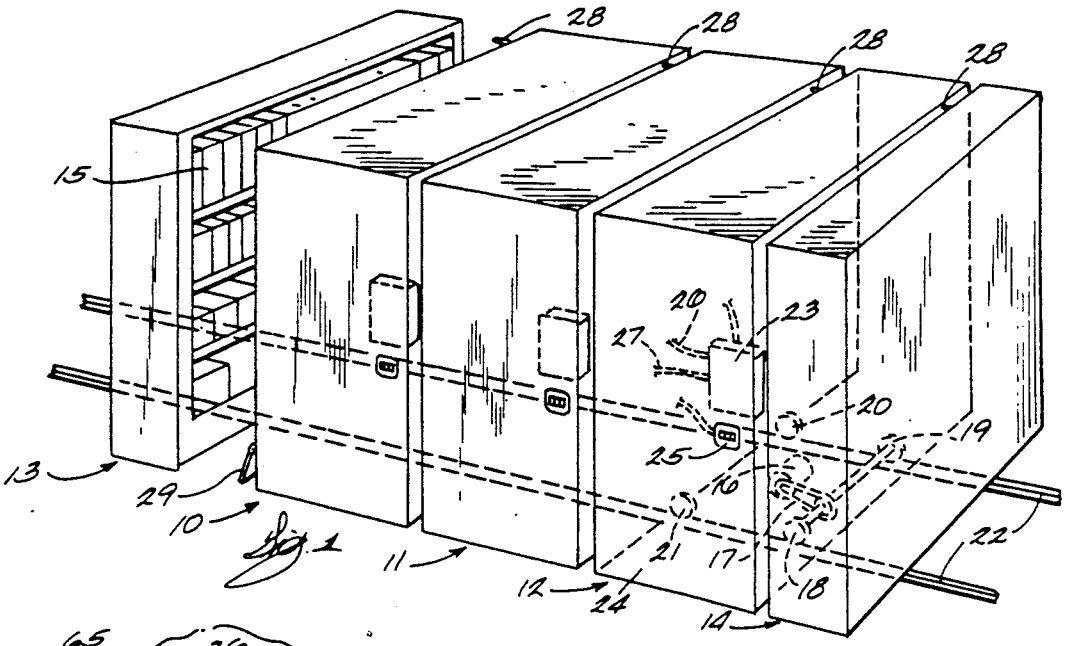
FIG. 1 is a diagram of a plurality of movable storage units, particularly three movable units in this example, which are located between two stationary end storage units and there is an aisle presently created between one of the stationary storage units and the movable storage units.

FIG. 1 is a front elevation diagram of several mobile storage units that are arranged to move alternately and selectively to the left and right as depicted to establish an access aisle between them at the command of a user. The mobile storage units are identified by the reference numerals 10, 11 and 12. In some installations there are a dozen or more of such units. The mobile storage units move between a pair of stationary storage units 13 and 14. As is well known, the storage units are commonly used to store hardware, books and files 15, for example. A typical mobile storage unit has a drive motor 16 mounted in it and it ]s coupled by means of a chain or belt drive 17 to a sprocket on a shaft which has wheels 18 and 19 on opposite ends. There are also a pair of idler wheels 20 and 21 which are mounted to a chassis, not shown, and run on tracks 22 which are often recessed in slots in the floor of the room in which the storage units are installed.

Each storage unit contains a microprocessor based control module such as the module which is marked 23 in storage unit 12 and is depicted in dashed lines because it is mounted in a space behind an upright end panel or wall 24 of the mobile storage unit 12. The mobile storage unit 12 in FIG. 1 exemplifies that each of the mobile storage units is provided with one of the new switch assemblies 25 adjacent each of the aisles which can be opened. Very wide storage units, not shown, are usually provided with switch assemblies at both ends. These switch assemblies 25 provide for operator control of the storage unit positions which are necessary to attain in order to create an aisle between any two storage units.

Storage unit 12 in FIG. 1 is illustrative of the fact that there are cable connections between the switch assemblies 25, the microprocessor based control modules 23, the drive motor 16 and there are cables interconnecting the control modules 23 in the several mobile storage units. A control module that could be used is described and shown in U.S. Pat. No. 4,759,592 and its disclosure is incorporated herein by reference. The patent is owned by the assignee of this application. For example, cable 26 may connect to the control module of the adjacent storage unit. Cable 27 may have the lead wires which communicate the control module 23 with various safety devices which are installed in the mobile storage units. These leads may lead to a limit switch such as the one, not visible, which is operated by the plunger 28 on storage unit 10. This plunger would operate the limit switch which would bring about stopping of the mobile storage unit when it abuts stationary unit 13, for example There is a limit switch plunger and a limit switch, not shown, on each of the storage units. There are also safety sweep switches which are operated by safety sweep panels such as the one marked 29. In practice, the mobile units have safety sweep switches on each side although all of them are not shown in the drawings. If a sweep panel encounters an obstruction such as a person or an object in the aisle when the aisle is being closed, the safety sweep device reacts by bringing about quick deenergization of the drive motor 16 whereupon movement of the units cannot be restored until the obstruction is removed and the circuitry in control module 23 is reset. U.S. Pat. No. 4,759,592 shows in greater detail the motor drive system and the wheeled chassis on which the storage units are mounted to provide for mobility.

Figure 2:
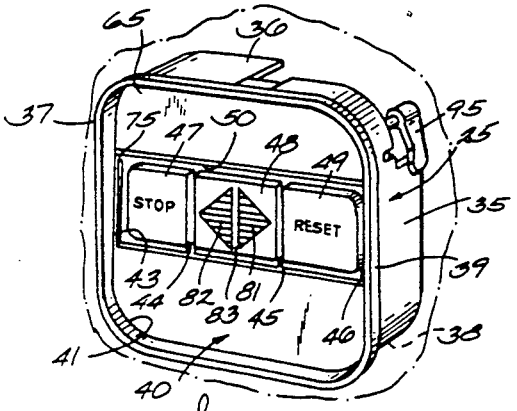
FIG. 2 is a front elevational perspective view of the new switch assembly.
Figure 3:
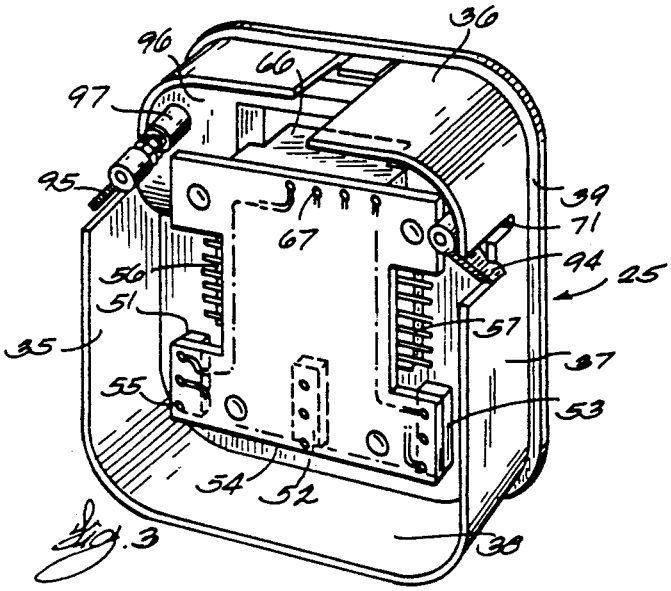
FIG. 3 is a rear elevational perspective of the switch assembly.

Attention is now invited to FIGS. 2 and 3, primarily, for a description of the new switch and circuitry assembly which is generally designated by the reference numeral 25. In these FIGURES, one may see that the assembly has a housing which is molded of plastic as a unit comprised of four walls 35, 36, 37 and 38. The pair of walls 35 and 37 are parallel to each other and walls 36 and 38 are parallel with each other. The walls define the boundaries of a space which, for convenience, is called an opening herein. The walls define a square housing for switch assembly 25 but the housing could be circular, triangular or rectangular or other shapes if desired. It should be apparent in these Figures that the front edges of walls 35–38 terminate in an outwardly extending flange 39 which acts as a stop when the switch assembly is installed in a wall through a hole whose configuration is the same as that of the walls which form the housing.

FIG. 2 shows that the housing opening has a panel 40 formed in it. The basic thickness of this panel, in this design, is about equal to the thickness of the walls comprising the housing but the panel has push button switch operating members 47–49 formed in it which are embossed or in relief. The panel 40 spans across the opening defined by the housing walls and joins integrally with opposite walls 35 and 37 along a junction line such as the one marked 41 in FIG. 2. The panel 40 has a laterally extending slit 42 which is formed in the dies, not shown, for the housing mold. The panel also has slits 43, 44, 45 and 46 which are perpendicular to lateral slit 42 and intersect it thereby dividing the panel into three switch operating members or push buttons 47, 48 and 49. The panel is not slitted along the upper edges 50 of switch operating members 47–49 such that the members are, in effect, supported in cantilever fashion from the laterally extending unslitted portion 50 of the panel. Because the plastic comprising the panel 40 and switch operating members 47–49 is rigid but elastic, the operating members can be deflected by a force applied with a finger for the purpose of operating an underlying switch as will be further described later. When the force applied with a finger is removed, the push buttons restore by themselves to their undeflected condition.

The switches operated by push buttons or switch operating members 47–49 are represented by the rectangular objects marked 51, 52 and 53 and are clearly visible in FIG. 3. These are subminiature switches. Typical switch 51 has its top side exposed in FIG. 4 to exhibit its operating plunger 76 when which is actuated by the one push button switch operator marked 49. The support member for these switches is a printed circuit board 54 and the support member switches are provided with protruding conductive pins such as the one marked 55 to provide for soldering the switches to the circuitry defined by the film conductors on the circuit board. There also are a pair of multiple pin connectors 56 and 57 mounted by soldering into the circuitry on the printed circuit board.

Figure 5:
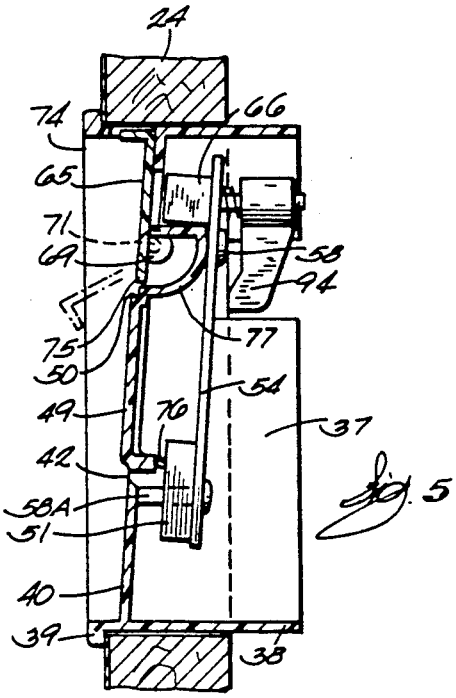
FIG. 5 is a vertical section taken on a line corresponding with 5—5 in FIG. 4.

Circuit board 54 is mounted on four plastic studs typical ones of which are marked 58 and 58A and are visible in profile in FIG. 5. The studs are shouldered and extend through appropriate holes in printed circuit board 54 and the board is retained on the studs by forming a mushroomed shaped head on them by melting the tips of the studs. A further discussion of the manner in which the circuit board is arranged in the switch assembly housing will be set forth later in reference to FIG. 5.

Figure 6:
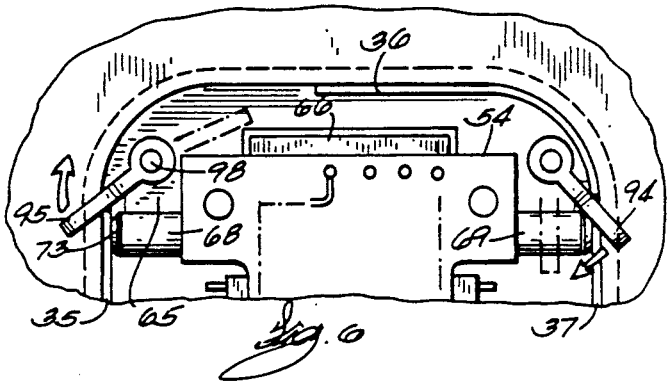
FIG. 6 is a partial rear elevational view of the switch assembly for demonstrating how the locking fingers operate.
Figure 4:
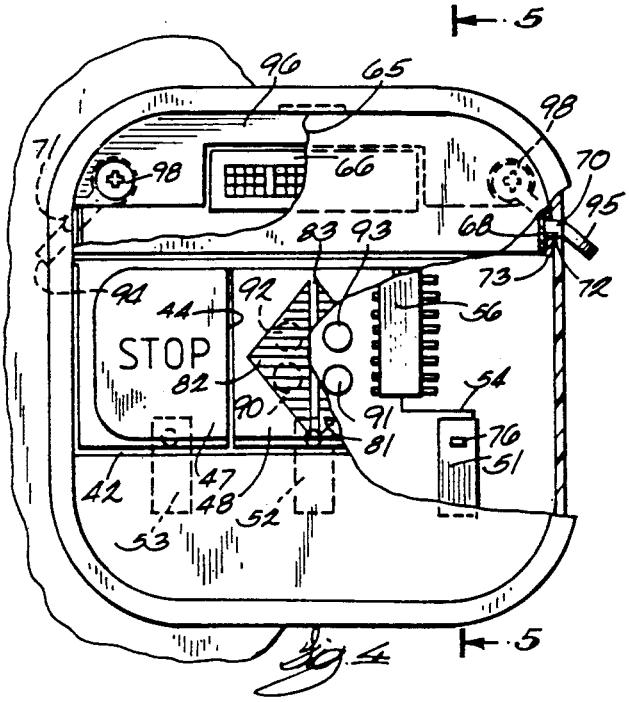
FIG. 4 is a front elevational view of the switch assembly with parts broken away and some parts in section.

Refer again to FIG. 2. Here one may see that in what is nominally the opening between the housing walls 35–38 and the margin 50 of the panel which supports the switch operating members 47–49 there is a door 65 which is presently closed in FIG. 2. In FIG. 4 where the door 65 is partly broken away and in FIG. 10 where the door 65 is shown swung to its open position one may see that the door conceals a multiple contact connector 66 which is also mounted to circuit board 54 by soldering connections such as those marked 67 in FIG. 3. The utility of this multiple contact connector 66 will be discussed later. As illustrated in FIG. 2, particularly well and also in FIG. 5, the laterally spanning panel 40 and the push button switch operating member such as the one marked 49 which is formed on the panel and the door 65 are coplanar but slanted inwardly at an angle relative to a vertical plane against which the edges 4 of the housing walls, particularly the flange 39 of the walls would lie against. As is evident in FIGS. 5 and 6, the rear side of the door 65 has a pair of cylindrical bosses 68 and 69 integrally molded on it. As is most evident in FIGS. 4 and 3, the ends of the bosses on the door have coaxial pintle pins 70 and 71 molded on them. Typical pintle pin 70 in FIG. 4 fits into the semicircular end of a slot 72 in housing wall 35. The slot end serves as a bearing for the pintle pin to enable the door 65 to swing between open and closed positions. Springing cup washers 73 surround the pintle pins and are interposed between the bosses 68 and 69 to impose some drag on the door so it will not flop open inadvertently.

The overall width of the door and pintle pins is greater than the distance between opposite side walls 35 and 37 of the switch assembly housing. Nevertheless, the door can be installed between the side walls by simply bending it in the shape of a bow to shorten it sufficiently for the pintle pins to fit in between the walls. When the pintle pins are aligned with the slots 72 in the side walls of the housing, the bowed door 65 is allowed to spring straight so that the pintle pins can snap into the slots 72. The door cannot slide out of position even though the pintle pins 70 and 71 reside in open ended slots because, as shown in FIG. 5, the bottom edge 75 of door 65 abuts the curved portion 76 of a channel which is molded integrally with panel 40 and which spans between side walls 35 and 37 of the housing. To open the door for the purpose of gaining access to the multiple terminal connector block 66 behind it, it is only necessary to apply force with a finger against the lower end 75 of the door to cause it to pivot about the axes of the pintles at which time the lower edge 75 wipes against the curved surface 77 of the channel so the door cannot shift by reason of the pintles shifting in the slots.

Figure 8:
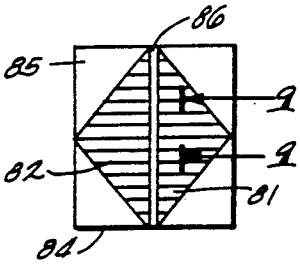
FIG. 8 is a front view of a wafer or plate which contains two indicating arrowheads which are light transmissive and prismatic.
Figure 9:
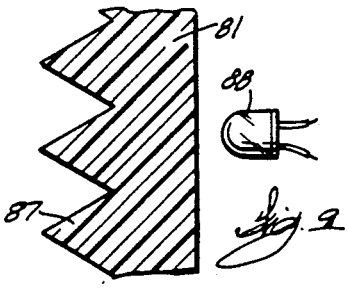
FIG. 9 is a section of one of the prismatic lenses taken on a line corresponding with 99 in FIG. 8.

The prismatic lens indicator arrows will now be discussed. As shown in FIG. 2, the arrow shaped or triangular prismatic lenses are installed, in this embodiment, in center switch operating member 48. The two arrows 81 and 82 are light transmissive and are separated by an opaque separator 83. The separator 83 is molded integrally with the operating member 48. Triangular openings are created during the molding process on each side of the separator 83 to accommodate the arrow. FIG. 8 shows a plate or wafer on which the prismatic arrows are formed. This plate or wafer is composed of plastic and is translucent rather than transparent. Plate 84 has flat corner areas 85 for facilitating gluing of the plate to the rear face of push button switch operator 48 such that the arrow head regions 81 and 82 underlay corresponding openings which are formed in push button switch operator 48 when the switch housing is molded. Plate 84 in FIG. 8 has a central smooth region 86 which is overlayed by the opaque separator 83 on the push button switch operating member 48. FIG. 9 shows a magnified section of arrowhead 81. It illustrates that the arrowheads are comprised of a series of laterally extending prisms 87 which have the optical characteristic of scattering or diffusing back light upwardly and downwardly when a light source such as the light emitting diode 88 behind the plate is illuminated. Thus, when the switch assembly is installed in electrically operated apparatus such as in mobile storage units a short person or a person whose eyes are at a relatively low level due to being confined to a wheelchair, for instance, sees the same uniform and intensity of light in the arrows as does a taller person who may be looking down at the arrows.

As illustrated in FIG. 4, there are four light emitting diodes 90, 91 and 92, 93 mounted to circuit board 54 behind the arrows 82 and 81. In an actual embodiment of the switch assembly, there is a green light diode (LED) behind arrow 82 and a green LED 91 to the rear of arrow 81. There is also a red emitting LED 92 behind the rear of arrow 82 and a red LED 93 behind arrow 81. Thus, various operating conditions can be indicated by variously illuminating the arrows. For example, one arrow may be bright green while the other is dark or both arrows can be made green at the same time. Similarly, one or both arrows can be made red individually or together. The switch operator 48 having the arrows is used to open an aisle in the mobile storage unit system. The control schedule is such that when the button is green, the user will push the button nearest the aisle to be opened and the storage units will begin movement under the influence of motor 16 to open the desired aisle. In installations where there is an optional overhead aisle light, not shown, it will light up when that aisle is opening. When all arrow buttons are green, a fully operational mobile storage system is indicated and any aisle can be opened. Any time the arrows' button 48 closest to the aisle desired to be opened is pushed, the storage units will begin moving sequentially. The arrow showing the direction of carriage movement during movement will be red.

The controller modules 23 can be programmed for enabling the arrows button 48 to function in alternative modes, a touch and hold mode or a one touch mode. In the touch and hold mode, the green arrows button 48 must be pressed and held until the aisle is fully opened. Releasing the button before the aisle is opened will cause the storage unit movement to stop. In the one touch mode, the green arrows button must be pressed only until the first mobile unit begins to move. Once it is moving, the button 48 may be released and the mobile units will continue to move sequentially until the selected aisle is fully open. To stop mobile unit movement softly, the reset switch operating button 49 must be pressed. To stop movement abruptly, any stop switch operating button 47 on any of the switch assemblies mounted to the mobile units may be pressed.

Figure 7:
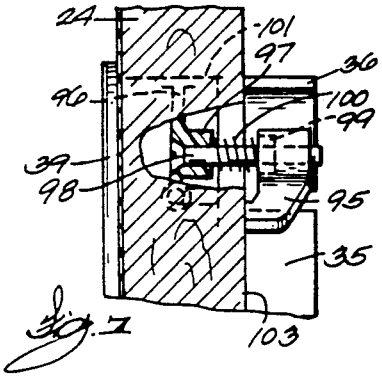
FIG. 7 shows a fragment of the switch assembly as it appears when it is locked or clamped to a wall after it has been inserted through a hole in the wall which corresponds to the external shape of the switch assembly housing.

The new switch 25 assembly is provided with means for installing it quickly. When the switch assembly is installed in a mobile storage unit, for example, the end wall such as typical end wall 24 of the storage unit 12 in FIG. 1 is provided with an opening which has the same outline as does the switch assembly 25 housing. The perimetral flange 39 on the housing stops the housing from passing entirely through the opening. The switch assembly is secured in a wall opening by means of two clamping fingers 94 and 95 in the illustrated embodiment. As can be clearly seen in FIG. 4, there is a laterally extending web 96 spanning laterally across the interior of the housing and molded integrally with the housing. This web is set rearwardly of the swinging door 65. As can be seen particularly well in FIGS. 3 and 7, there are cylindrical bosses such as the one marked 97 protruding integrally and rearwardly from web 96. As is evident in FIG. 7, boss 97 has a clearance hole through which a screw 98 extends. Clamping finger 95 is threaded onto screw 98. The cylindrical central part of the clamping finger 95 has a recess 99 which accommodates one end of a coil spring 100 which is fitted over the screw and is interposed between the end of boss 97 and the clamping finger. Before the switch assembly is installed in the opening 101 of a wall 24 as exhibited in FIGS. 5 and 7, typical screw 98 is engaged with a screwdriver and rotated until clamping finger 95 and its counterpart 94 are displaced inwardly of the housing walls so the housing fits through the opening. Before installing the housing, of course, connectors, not shown, can be attached to the multi-pin connectors 56 and 57 which are mounted on the circuit board of the housing. To cause the clamping fingers 94 and 95 to swing inwardly of the housing to clear the side walls, they are swung in the direction of the arrows in FIG. 6 until they reach the positions in which they are shown in phantom lines in this Figure. After the switch assembly is inserted through the wall opening, the clamping fingers are swung outwardly, as they appear in solid lines in FIGS. 3, 4 and 7, by turning the screws 98 in the appropriate direction. The right hand threaded screws 98 for the clamping fingers in this embodiment are then turned clockwise so the threaded screws advance in the cylindrical portion of the fingers and draw the fingers into contact with the inside surface 103 of the wall as depicted in FIG. 7. If it should ever be necessary to remove the switch assembly from the storage unit wall, the screws would be turned counterclockwise looking at their head ends so they would back out of the clamping fingers 94 and 95. The springs 100 maintain some drag on the clamping fingers so that they will remain in their concealed position where they are turned by the screws so they cannot swing into a position where they could block easy removal of the switch assembly.

The key devices which cooperate with the multi-terminal connector 66 will now be discussed. The key device known as the safety override key 110 is an optional accessory and is used when there is a storage unit shut down caused by an activated aisle safety device such as the safety floor sweep 29 which may have impacted an object left in an aisle. This would prohibit moving the storage units in the direction of the red flashing arrow which indicates there is a fault in the direction in which the arrow points. The safety override key 110 is plugged into the key slot, that is, into connector 66 at the closing aisle for the control buttons to work. The key device will emit a beep while it is inserted and the mobile unit is moving, putting a warning signal at the closest proximity to the closing aisle. The safety override key device 110 casing contains a beep sounding device, not visible, located behind the plurality of holes 111 which allow the sound to pass outwardly. Inside of the plastic casing of the device 110 there is a flat insulating strip 112 on which a plurality of thin film conductors 113, such as are typical of printed circuit boards, are bonded. These conductors are variously connected inside of the casing to form electrical connections. When the mouth end 114 of the device 110 is plugged onto the multiple contact connector 66, the conductors 113 complete electric circuits cause the function just described to be executed. The safety override key device 110 can only be inserted into connector 66 in one way as a result of the strip 112 in the key device having a slot 115 which must register with a stop pin 117 in the connector for the slot to slide over the connector and allow the multiple terminals of the connector 66 to make contact with the conductive strips 113.

Figure 11:
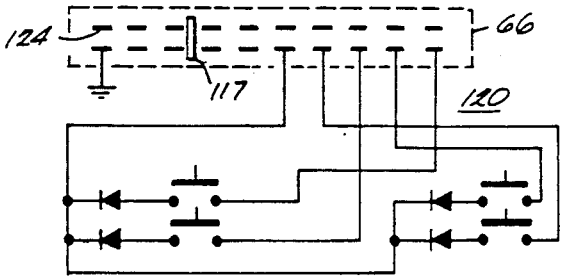
FIG. 11 is a circuit diagram located in the interior of one of the key devices in FIG. 10, for illustrating the general nature of the key devices.
Figure 10:
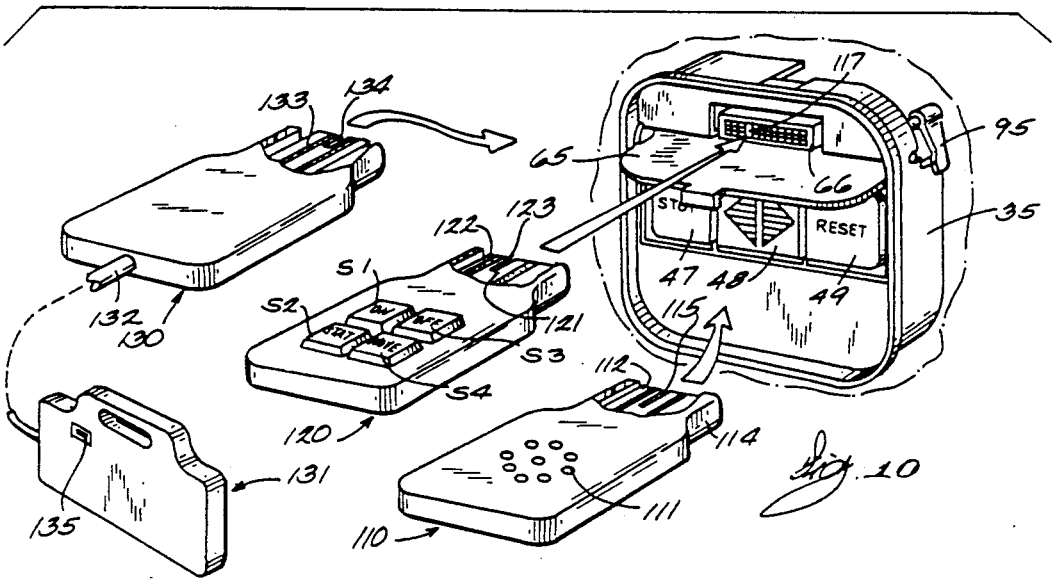
FIG. 10 is a front elevational perspective view of the switch assembly wherein a door of the assembly is opened to expose a multiple contact connector in conjunction with three different hand held key devices which are adapted to plug into the connector to perform various control functions.

The programmable key device 120 in FIG. 10 will now be described. It can control the system to the exclusion of other controls. This key device can make the entire plurality of storage units for any individual unit non-operational. This is a security measure to limit unauthorized access to the system for a selected aisle or to lock the system up over night, for instance. The casing of device 120 has four push buttons mounted in it. They are labeled, respectively, "on", "off", "stat", and "move". In this particular example, the "off" button (S3) is red, the "on" button (S1) is green, the two other buttons, "stat" (S2) and "move" (S4) are blue. There is a circuit board 121 in device 120 and it has conductive strips such as the one marked 122 bonded on it. There is an indexing slot 123 in the board which assures that it can only be plugged into multiple contact connector 66 in registry with stop pin 117 so that the proper conductors in the device 120 are in contact with the proper contacts of connector 66. To turn the system on, the key device 120 is plugged into connector 66 and the green "on" button is pressed for at least one second. To turn the system off, the key is inserted and the red "off" button is pressed. A circuit diagram for key device 120 is shown in FIG. 11. Here one may see that there are six conductive strips 122 which engage with the contacts 124 of connector 66. The push button switches S1–S4 are shown and labeled and there are light emitting diodes D1–D4 which direct the flow of current in the circuit.

There are programmable carriage functions which are controlled by the blue "stat" S2 and blue "move" S4 buttons on key device 120. Their purpose is to program storage units as temporary stationary units. To convert a movable storage unit to a stationary unit, the key device 120 is inserted in connector 66 and the blue "stat" push button S2 is pressed. The outside arrows 81 and 82 will light, indicating that the aisles to the left and right of this storage unit can be opened but the storage unit itself will not move. The key device 120 can then be unplugged from connector 66. If the system has sufficient aisle space, programming a storage unit as a stationary unit breaks the system into two different separate modules with independent movement and aisle safety devices All safety devices will still function throughout the system.

To reprogram the stationary storage unit back to a movable unit, key device 120 is plugged into connector 66 again and the blue move button switch S4 is pressed.

Referring to FIG. 10 again, a third key device 130 and a hand-held power pack 131 constitute an optional power override. This device is used when there has been a power failure at a time when it is necessary to have access to something on the shelves of the storage unit which is abutted to its neighbor at the time the power failed. The power pack 131 is occupied by batteries, not shown. The power pack connects to the key device 130 by means of a cable 132. The mouth end of the casing is broken away to show that the casing contains an insulating strip 133 on which there are electrical conductors 134 which make contact with predetermined contacts in the multiple contact connector 66 when the device 130 is plugged onto the connector. The power pack 131 is provided with a selector switch 135. The selector switch on the power pack is pressed to the right or left depending on the desired movement of the storage unit into which the key device 130 is plugged. The storage unit moves at a slower speed than normal and a warning beep sounds to alert personnel that an aisle is being closed.

Although the structure and functions of the new switch assembly by itself and in combination with an electrically operated device such as a mobile storage unit has been described in considerable detail, such description is intended to be illustrative rather than limiting, for the basic principles of the invention may be variously embodied and the scope of the invention is to be limited only be interpretation of the claims which follow.

We claim:

1. A switch assembly comprising:

a plastic housing including opposite pairs of wall means molded in one piece and arranged to define the boundaries of an opening, a plastic panel which has a front side and a rear side and spans across said opening so as to overlay part of the area of the opening, said panel being molded integrally with said wall means and having a generally laterally extending slit and a plurality of longitudinally extending slits which intersect with the laterally extending slit to divide a portion of the panel into independent switch operating members which have free edges contiguous with the slits, one portion of each switch operating member remaining joined with said panel and supported in cantilever fashion to provide for deflecting in response to application of a force on said front side of the member and for restoring to undeflected condition when the force is removed, support means positioned on said rear side of said panel and switch means mounted to said support means in proximity to said switch operating members, a door and means for mounting the door on said housing for swinging between a closed position wherein the door overlays and closes another part of the area of said opening adjacent said panel and an open position wherein said opening is exposed, a multiple contact electrical connector mounted to said support means in a position for being concealed when said door is closed and for being visible and accessible when said door is opened.

2. The switch assembly according to claim 1 wherein:

said door is comprised of a generally planar plastic door panel having laterally spaced apart side edges and nominal upper and lower edges extending between the side edges, said door spanning between opposite walls of said housing for said side edges to be contiguous to the walls, a plastic pintle extending laterally away from each of said side edges of the door, said pintles being molded integrally with the door and being coaxial for allowing said door to swing, said opposite walls having holes for entry of said pintles, respectively, and for serving as bearings in which said pintles turn when the door is swung, said door being flexible enough to be forcibly bent or deflected sufficiently for said laterally extending pintles on the door to fit between said opposite walls to provide for said door to be pushed between said walls until said pintles enter said holes under the influence of the force stored in said door due to said deflection.

3. The switch assembly according to claim 2 including:

walls formed integrally with said rear side of said panel and extending laterally of said housing and configured to form channel means, one of the walls forming the channel means being curved and having a radius of curvature relative to the axis of the pintles substantially equal in length to the distance between said axis of the pintles and said nominally bottom edge of said door such that when said door swings said bottom edge of the door slide on said wall which is curved.

4. A switch assembly comprising:

a plastic housing including opposite pairs of wall means molded in one piece and arranged to define the boundaries of an opening, a plastic panel which has a front side and a rear side and spans across said opening so as to overlay part of the area of the opening, said panel being molded integrally with said wall means and having a generally laterally extending slit and a plurality of longitudinally extending slits which intersect with the laterally extending slit to divide a portion of the panel into independent switch operating members which have free edges contiguous with the slits, one portion of each switch operating member remaining joined with said panel and supported in cantilever fashion to provide for deflecting in response to application of a force on said front side of the member and for restoring to undeflected condition when the force is removed, support means position on said rear side of said panel and switch means mounted to said support means in proximity to said switch operating members, said wall means in each pair of walls comprising said housing being in parallelism and perpendicular to a single imaginary plane, said wall means having front edges which terminate against said plane, said plastic panel being slanted inwardly of said opening defined by said wall means at an angle relative to said imaginary plane, a plurality of elements which respond to electrical energization by emitting light, some of said elements emit light of one color and others emit light of another color, said elements being arranged in said housing rearwardly of said rear side of a said switch operating member;

said last mentioned switch operating member having a generally diamond shaped window and light transmissive prismatic lens means disposed in the window, said lens means comprising a plate composed of a plurality of contiguous laterally extending prisms which result in the lens means having a sawtooth cross sectional configuration, an opaque narrow divider element extending across the window transversely of said laterally extending prisms for dividing said window and lens means into separate triangularly shaped lens areas constituting arrows which point in opposite directions, a light emitting element of one color and a light emitting element of another color being positioned on the rear side of each arrow.

5. The switch assembly according to claim 4 wherein green is said one color and red is said another color.

6. A switch assembly comprising:

a plastic housing including opposite pairs of wall means molded in one piece and arranged to define the boundaries of an opening, a plastic panel which has a front side and a rear side and spans across said opening so as to overlay part of the area of the opening, said panel being molded integrally with said wall means and having a generally laterally extending slit and a plurality of longitudinally extending slits which intersect with the laterally extending slit to divide a portion of the panel into independent switch operating members which have free edges contiguous with the slits, one portion of each switch operating member remaining joined with said panel and supported in cantilever fashion to provide for deflecting in response to application of a force on said front side of the member and for restoring to undeflected condition when the force is removed, support means positioned on said rear side of said panel and switch means mounted to said support means in proximity to said switch operating members, means for releasably clamping said switch assembly in a hole in a wall-like member, said switch assembly additionally including:

rim flange means formed integrally with the wall means comprising said housing, said flange means extending laterally outwardly of the perimeter of the housing, a pair of laterally spaced apart bosses projecting integrally from opposite wall means in an area of said opening adjacent said panel on which said switch operating members are formed, said bosses each having a through hole, the axes of the holes being parallel to said wall means, a screw extending through each of said bosses, the screw having a head stopped on one side of the boss and having a thread presented on the other side of the boss, a clamping finger screwed onto the threads of each screw and said clamping finger extending radially from said screw and a coil spring concentric with each screw and interposed between the boss and clamping finger, turning of said screws in one direction causing said fingers to swing inwardly of the housing to allow said housing to be inserted into said hole in said wall-like member, said wall means having an opening defined by wall edges adjacent each of said clamping fingers, turning said screws in the opposite direction causing said clamping fingers to swing through said openings, respectively, and stop against the edges thereof such that further turning of the screws will draw the clamping fingers into clamping engagement with said wall-like member while said rim flange prevents the switch assembly housing from moving through said hole.

7. The switch assembly according to claim 6 including:

a door and means for mounting said door on said housing for swinging between a closed position wherein the door overlays and closes said area of the housing opening adjacent said panel, said support means on said rear side of said panel comprising a circuit board, a multiple contact connector mounted to said circuit board and extending into said part of the area of the housing opening adjacent said panel in a position wherein said connector is accessible when said door is open and is concealed when said door is closed, said heads of the screws for said clamping fingers also being accessible when said door is open and concealed when said door is closed.

8. A switch assembly comprising:

a plastic housing including opposite pairs of wall means molded in one piece and arranged to define the boundaries of an opening, a plastic panel which has a front side and a rear side and spans across said openings so as to overlay part of the area of the opening, said panel being molded integrally with said wall means and having a generally laterally extending slit and a plurality of longitudinally extending slits which intersect with the laterally extending slit to divide a portion of the panel into independent switch operating members which have free edges contiguous with the slits, one portion of each switch operating member remaining joined with said panel and supported in cantilever fashion to provide for deflecting in response to application of a force on said front side of the member and for restoring to undeflected condition when the force is removed, support means positioned on said rear side of said panel and switch means mounted to said support means in proximity to said switch operating members, a mobile storage unit that is supplied with electric power from power mains and to which said switch assembly is mounted, said storage unit including wheels for allowing the unit to move on tracks, reversing electric motor means mounted to the unit and means coupling said motor means to the wheels for driving the unit bidirectionally on the tracks, said storage unit including an upright end panel and at least one of said switch assemblies mounted in said end panel, said storage unit having an electrical controller thereon operative in response to control signals to control operation of the storage unit, said switch assembly having an electrical connector mounted thereon, said connector having a row of contacts which are electrically insulated from each other, an auxiliary electric power source for supplying power to the storage unit independently of said power from the mains to permit movement of the storage unit when power from the mains is interrupted, said auxiliary electric power source including a key device comprising an insulating casing and an insulating member in the casing having conductors thereon which are arranged to mate with and connect with predetermined ones of said contacts in said electrical connector when said key device is coupled to said connector to provide auxiliary power to said controller and motor, and a container for storage batteries and conductors for connecting storage batteries in the container to said conductors in said insulating member so electric power is transmitted when said conductors in the key member and said predetermined contacts are mated.

9. A switch assembly comprising:

a plastic housing including opposite pairs of wall means molded in one piece and arranged to define the boundaries of an opening, a plastic panel which has a front side and a rear side and spans across said opening so as to overlay part of the area of the opening, said panel being molded integrally with said wall means and having a generally laterally extending slit and a plurality of longitudinally extending slits which intersect with the laterally extending slit to divide a portion of the panel into independent switch operating members which have free edges contiguous with the slits, one portion of each switch operating member remaining joined with said panel and supported in cantilever fashion to provide for deflecting in response to application of a force on said front side of the member and for restoring to undeflected condition when the force is removed, support means positioned on said rear side of said panel and switch means mounted to said support means in proximity to said switch operating members, a mobile storage unit that is supplied with electric power from power means and to which said switch assembly is mounted, said storage unit including wheels for allowing the unit to move on tracks, reversing electric motor means mounted to the unit and means coupling said motor means to the wheels for driving the unit bidirectionally on the tracks, said storage unit including an upright end panel and at least one of said switch assemblies mounted in said end panel, said storage unit having an electrical controller thereon operative in response to control signals to control operation of the storage unit, said switch assembly having an electrical connector mounted thereon, said connector having a row of contacts which are electrically insulated from each other, a key device for limiting control of said storage unit to one possessing the key member and comprised of an insulating body having an opening configured for mating with said electrical connector, said casing containing an insulating member presented toward the opening and a plurality of conductors on said member which conductors are arranged for connecting to predetermined contacts in said connector, push button switches mounted to said insulating casing of the key device, said push button switches being connected to predetermined ones of said conductors on said insulating member of the key device so as to develop electric control circuits when said conductors engage predetermined ones of said contacts in the connector when the key device and connector are connected, operation of one of said push buttons providing a signal to said controller which results in said motor means moving said storage unit and operation of another of said push buttons causing movement of the storage unit to stop.

10. A switch assembly comprising:

a plastic housing including opposite pairs of wall means molded in one piece and arranged to define the boundaries of an opening, a plastic panel which has a front side and a rear side and spans across said opening so as to overlay part of the area of the opening, said panel being molded integrally with said wall means and having a generally laterally extending slit and a plurality of longitudinally extending slits which intersect with the laterally extending slit to divide a portion of the panel into independent switch operating members which have free edges contiguous with the slits, one portion of each switch operating member remaining joined with said panel and supported in cantilever fashion to provide for deflecting in response to application of a force on said front side of the member and for restoring to undeflected condition when the force is removed, support means positioned on said rear side of said panel and switch means mounted to said support means in proximity to said switch operating members, a mobile storage unit that is supplied with electric power from power mains and to which said switch assembly is mounted, said storage unit including wheels for allowing the unit to move on tracks, reversing electric motor means mounted to the unit and means coupling said motor means to the wheels for driving the unit bidirectionally on the tracks, said storage unit including an upright end panel and at least one of said switch assemblies mounted in said end panel, said storage unit having an electrical controller thereon operative in response to control signals to control operation of the storage unit, said switch assembly having an electrical connector mounted thereon, said connector having a row of terminals which are electrically insulated form each other, a key device usable to cause said storage unit to move when movement would otherwise be prevented because a safety device has responded to occurrences of an unsafe condition, said key device comprising an insulated body having an opening configured for mating with said electrical connectors, said body containing an insulating member presented toward the opening and a plurality of conductors on said insulating member which conductors are arranged for connecting to predetermined terminals in said connector, said conductors being interconnected such that electric circuits are completed when conductors in the key device and predetermined ones of the terminals in said connector are connected.

11. The key device according to claim 10 including a sound generating device which is energized by current fed to selected ones of the conductors on said insulating member when said key device is connected to said connector.

* * * * *